United States Patent [19]

Carr

[11] 4,301,601

[45] Nov. 24, 1981

[54] HAIR STYLING SYSTEM

[76] Inventor: Uriah H. Carr, 8852 S. Michigan Ave., Chicago, Ill. 60619

[21] Appl. No.: 949,875

[22] Filed: Oct. 10, 1978

[51] Int. Cl.[3] ..... A45D 20/22

[52] U.S. Cl. ..... 34/3; 34/99; 132/9

[58] Field of Search ..... 34/92, 99, 3, 96, 100, 34/101; 132/9

[56] References Cited

U.S. PATENT DOCUMENTS

| | | | |
|---|---|---|---|
| 2,416,788 | 3/1947 | Andrews | 34/99 |
| 2,437,366 | 3/1948 | Thomas | 34/99 |
| 2,503,113 | 4/1950 | Hribar | 34/99 |
| 3,372,491 | 3/1968 | Morrison | 34/99 |
| 3,908,673 | 9/1975 | Carr | 132/9 |
| 4,112,591 | 9/1978 | Marsh | 34/99 |

*Primary Examiner*—Larry I. Schwartz

*Attorney, Agent, or Firm*—Hill, Van Santen, Steadman, Chiara & Simpson

[57] ABSTRACT

A hair styling system is disclosed wherein a hair styling mold is placed on the head of an individual whose hair is to be styled. Surface contours of the hair styling mold are spaced from the head of the individual and correspond with a desired shape of the hair style. The hair styling mold is receivable in a hood which provides a defined airflow. The hair styling mold is designed to permit such airflow therethrough and an airflow generating unit connected to the hood creates the airflow through the mold for drying the hair in the shape provided by the surface contours of the hair styling mold.

15 Claims, 5 Drawing Figures

HAIR STYLING SYSTEM

BACKGROUND OF THE INVENTION

In my eariler U.S. Pat. No. 3,908,673, issued Sept. 30, 1975, a mesh-like mold is disclosed which is positioned about the head of the user and which has a surface contour corresponding to a selected hair style or coiffure. Hot air is then blown through the mesh-like mold so as to dry the hair in accordance with the shape of the mold.

With the mold of the aforementioned patent, it is necessary to manually dry individual sections of the hair. Also, there is a possibility that with hair which is limp or heavily moistened, the force of the air from the external manual blower will cause the hair to be blown away from contact with the mold.

With a currently popular hair style known as an "afro" or "natural", the entire head of hair is to be styled such that each individual strand stands straight out from the scalp. Such hair styles, emphasizing the natural texture of "kinky" or "wooly" hair, require for acceptable appearance, an outer surface having a smooth continuing curved contour without creating a matted or pasted down appearance. With the mesh-like mold of my previous patent, such a hair style could be created with careful application of an external blower for generating airflow externally through the mesh towards the head of the individual. However, as noted above, in many cases, it would also be desirable to selectively permit airflow outwardly from the head of the user so as to align strands of the hair outwardly from the head of the user towards and into contact with an inner surface of the mold.

SUMMARY OF THE INVENTION

It is an object of this invention to provide an improved hair styling system wherein an even distribution of airflow can be created through a hair shaping mold placed on the head of an individual.

It is a further object of this invention to provide an improved hair styling mold which is resilient yet has sufficient rigidity to function as a mold, and wherein said mold has a coating of a first polyurethane type for toughness and a second polyurethane type for rigidity.

It is another object of this invention to provide a hair styling system wherein an even distribution of airflow can be affected through a hair shaping mold on a head of an individual and wherein the direction of the air flow through the mold can be selectively reversed.

It is another object of this invention to provide a hair styling system in which strands of hair on an individual are drawn by an airflow away from the head of the individual toward and into contact with a hair shaping mold positioned over the hair.

According to the invention, a hair styling mold is provided which is receivable over a head of an individual and which has an inner surface with contours corresponding to a desired hair style. The mold is designed to permit an even flow of air through the inner surface thereof. The mold is received within a hood which has apertures therein for creating an even distribution of air flow to or from the hood and for thus creating a positive airflow through the hair styling mold towards or away from the individual's head. An airflow generating means is connected to the hood apertures which may be selectively connected to either an air blower or a vacuum source.

DESCRIPTION OF THE PREFERRED EMBODIMENTS

Figure 1:
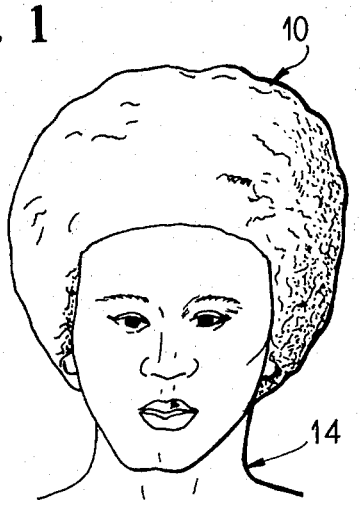
FIG. 1 is a pictorial representation illustrating the appearance of an individual having a kinky or wooly textured head of hair to be styled.
Figure 2:
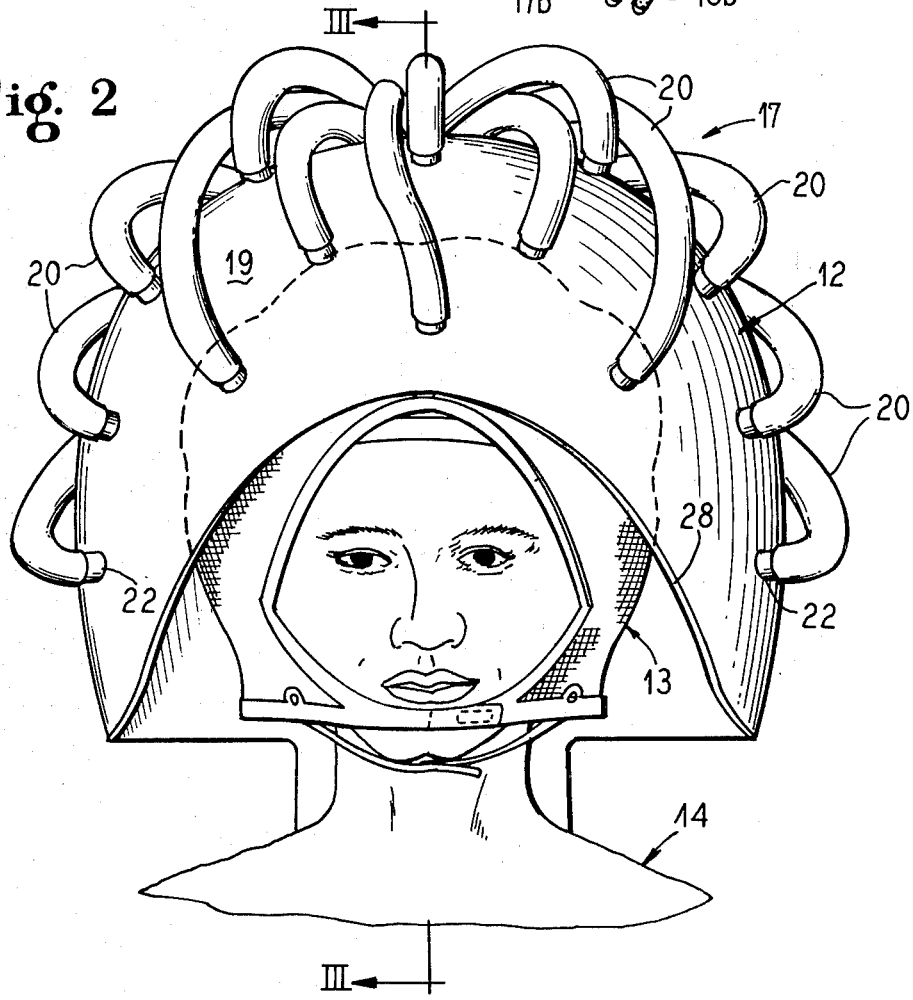
FIG. 2 is a front view of the hair styling system of the invention during operation.
Figure 3:
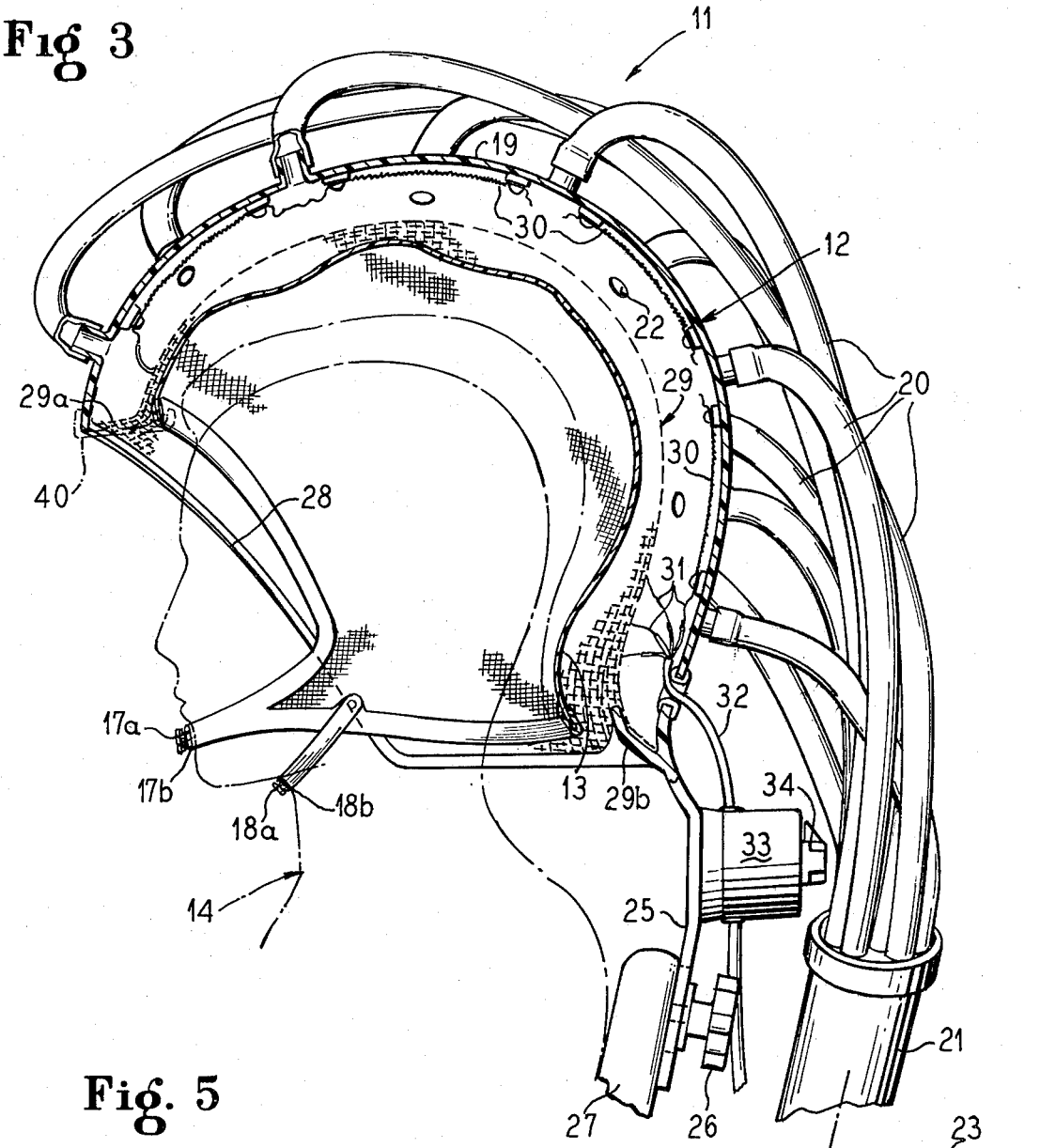
FIG. 3 is a side cross-sectional view taken along line III-III of FIG. 2.

FIG. 1 illustrates generally at 10 a head of hair to be shaped, typically in an "afro" or "natural" hair style. As shown in FIGS. 2 and 3, the hair shaping apparatus generally shown at 11 includes a hair shaping or styling mold 13 which is placed on the head of an individual 14. The styling mold 13 is received within the helmet-like hood 12 having inner dimensions chosen to permit positioning of the styling mold 13 therein in a relatively close fitting configuration. Also illustrated in FIG. 3, a plurality of connecting hoses 20 are provided which connect to apertures or nozzles 22 on the hood 12 for the purpose of introducing airflow through the curved surface of the hood 12. These connecting hoses 20 connect via a larger main hose 21 to a vacuum source 23 such as a home vacuum cleaner or a blower 24 which may have a heated air intake 24*a*. The blower 24 could typically be a conventional hair dryer.

Figure 4:
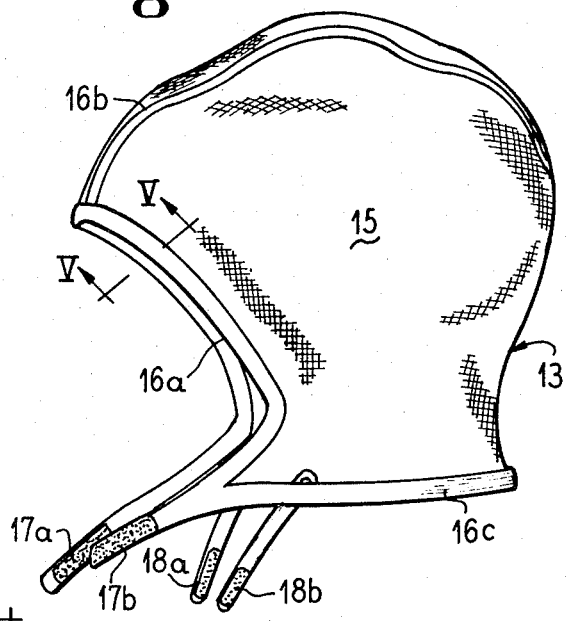
FIG. 4 is a side view of a hair styling mold utilized in the hair styling system of the invention and which is received over a head of the individual whose hair is to be styled.

As shown most clearly in FIG. 4, the hair shaping or styling mold 13 has a mold surface 15 formed of fiberglass coated with polyurethane. The mold surface 15 is contoured to correspond to the hair style or coiffure desired and has compound curves and design patterns. A reinforcement trim 16*a* is provided at a front of the mold 13. Also, a reinforcement trim 16*b* is provided over a crown of the mold. A lower reinforcement trim 16*c* surrounding a bottom of the mold is provided. This reinforcement trim is also integral with chin fastener strips 17*a, b* having a Velcro connection strip thereon. Neck fastening strips 18*a* and 18*b* are also provided having Velcro connection strips.

As shown in FIGS. 2 and 3, the hood 12 is formed of a substantially spherical outer hard shell 19 which has a plurality of apertures or nozzles 22 therein to which individual connecting hoses 20 are connected. The connecting hoses 20 are joined to a larger main hose 21 which connects with a vacuum source 23 or a blower 24. A support arm 25 shown clearly in FIG. 3 supports the hood 12 in position relative to a support surface 27 such as the back of the chair. A thumb screw 26 provides an adjustable clamping system.

A front edge opening 28 is provided in the hood 12 through which the face of the individual receiving the hair style is visible. A protection screen 29 is provided between the styling mold 13 and the hard shell 19 of the hood 12. This screen 29 is connected at 29*a* and 29*b* to the inner surface of the hood 12. This screen spaces the outer surface of the styling mold 13 from the inner surface of the hood 12 and also prevents contact between the styling mold 13 and heating elements 30 which are distributed over an inner surface of the hood 12.

The heating elements 30 preferably comprise resistance type heating elements or may be provided as small heat lamps. Connecting wires 31 connect the heating elements 30 via a cable 32 to a control unit 33 having an adjustment knob 34 for controlling heat output of the heating elements 30.

Figure 5:
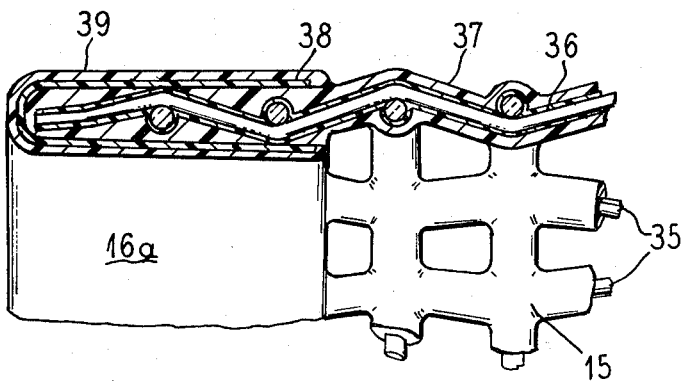
FIG. 5 is a fragmentary cross-sectional view taken along line V—V of FIG. 4 and illustrating construction of the hair styling mold utilized in the invention.

FIG. 5 illustrates construction of the hair styling mold 13 generally illustrated in FIG. 4. The mold surface 15 is formed of a fiberglass mesh 35 having a thin coating 36 of 70d polyurethane thereon. 70d polyurethane provides a stiffening of the mesh. Thereafter, a coating 37 of 60a polyurethane is applied which provides a tough wear-resistant yet elastic outer finish for the molds and which prevents cracking thereof. The 70d polyurethane and 60a polyurethane coatings may also be mixed and applied simultaneously.

The reinforcement trim 16*a* is formed of a fiberglass cloth ribbon 38 bent over an outer edge of the fiberglass mesh 35 and is attached to the fiberglass mesh by impregnation in a mixture 39 of 70d and 60a polyurethane. Preferably 75 percent 70d polyurethane is employed and 25 percent 60a polyurethane so as to provide greater stiffness than is the case for the mold surface 15.

The terms "70d polyurethane" and "60a polyurethane" are terms well known to those skilled in the plastics art. These polyurethanes are promoted and sold by distributors under the above designations. One such distributor is High Strength Plastics of 1701 North Damen, Chicago, Ill.

The hair styling system of the invention operates as follows. Initially, the hair 10 of an individual 14 is moistened. Thereafter, the hair styling mold 13 is placed on the individual's head and the chin and neck fastening strips 17*a, b* and 18*a, b* respectively are closed. The mold surface 15 is spaced from the head of the individual 14 and is contoured according to the desired hair style or shape. The hair styling mold 13 having the individual's head therein is then positioned within the hood 12. The protective screen 29 spaces the outer surface of the mold 13 from the inner surface of the hood 12. If a more rigid fixation of the mold 13 in the hood 12 is desired, a retaining member 40 may be attached between an upper portion of the mold 13 and the hood 12.

Thereafter, a vacuum source 23 is applied and air is drawn from areas adjacent the head of the individual 14 radially outwardly through the mold 13 and then to apertures 22 in the hood 12. This has the effect of lifting the hair and holding it in contact against the shaping mold for a sufficiently long time while it dries. Simultaneously, the heating elements 30 are activated. As the hair dries, a shape is imparted which corresponds with the contours of the styling mold 13.

Alternatively, if the individuals hair naturally "stands up" and does not need lifting, but would benefit from a compression during the shaping process, a blower 24 is attached to the hose 21 so as to create an airflow from the apertures of the hood through the styling mold 13 towards the head of the individual.

Although the teachings of my invention have herein been discussed with reference to specific theories and embodiments, it is to be understood that these are by way of illustration only and that others may wish to utilize my invention in different designs or applications.

I claim as my invention:

1. A hair styling system comprising:

(a) a resilient hair styling mold means for surrounding an individual's hair and having an inner surface with a contour corresponding to a desired hair style, said hair styling mold having means for permitting airflow through the inner surface, said hair styling mold being a separate cap structure receivable on a head of an individual and having substantial rigidity to maintain the inner fixed contour during drying;

(b) separate hood means dimensioned to freely receive the hair styling mold therein, said hood means having air-flow means for providing airflow through the hair styling mold for drying and setting the individual's hair; and (c) said airflow means including a vacuum means for causing the airflow from areas adjacent the hair through the hair styling mold so as to draw the individuals hair towards and in contact with the mold means inner surface.

2. The system of claim 1 wherein heating means is provided between the mold means and hood means.

3. The system of claim 1 wherein the airflow means also includes a blower means for selectively causing airflow from the hood means through the mold means and towards the individual's hair.

4. The system of claim 3 wherein the blower means comprises a hot air blower.

5. The system of claim 1 wherein the mold means is formed of a mesh.

6. The system of claim 5 wherein the mesh comprises a fiberglass coated with polyurethane.

7. The system of claim 1 wherein the mold means is formed of a fiberglass mesh coated with polyurethane for stiffness and toughness, and a reinforcing trim strip is provided at edges of the mold.

8. The system of claim 6 wherein the polyurethane coating the fiberglass mesh comprises a first polyurethane means for stiffening the mesh and second polyurethane means for toughening a surface of the mold to prevent cracking.

9. The system of claim 1 wherein the mold means has straplike support means for mounting the mold means on the head of the individual.

10. The system of claim 1 wherein the hood means airflow means comprises a plurality of apertures distributed over a surface of the hood means, and said apertures being connected with airflow tubes.

11. The system of claim 1 wherein protective means are provided for maintaining a separation between another surface of the mold means and an inner surface of the hood means when the mold means is positioned within the hood means.

12. The system of claim 11 wherein the protective means comprises a screen mounted inside the hood means at a predetermined spacing from the inner surface of the hood means.

13. A method of styling hair on the head of an individual, comprising the steps of:

(a) moistening the hair to be styled and placing a hair styling mold in contact with an individual's hair and which permits airflow therethrough on the head of the individual, said mold having contours corresponding to the hair style desired;

(b) freely placing the head of the individual with the hair styling mold in place into a separate hood having an airflow means connected thereto; and (c) activating the airflow means to create a flow of air from areas adjacent the hair through the hair styling mold towards the hood so as to lift the hair into contact with the mold and dry the hair in the shape of the contours of the mold.

14. The method of claim 13 wherein an airflow through the hair styling mold toward the individual's head can also be selectively provided.

15. A hair styling system comprising:

(a) a resilient mold means for placement on the head of an individual whose hair is to be styled, said mold means having air penetrable surface means which is spaced from the head of the individual when the mold means is on the head and which has surface contours which correspond to a desired hair style and are in contact with the hair when placed on the head;

(b) separate hood means for freely receiving the mold means therein when the hood means is on the head of the user and for providing an air flow through the mold means for drying the hair in the style defined by the mold means surface contours; and (c) airflow means for providing said airflow selectively both in a direction toward the head or away from the head.

* * * * *